US005220979A

United States Patent [19]

Matsuda

[11] Patent Number: 5,220,979

[45] Date of Patent: Jun. 22, 1993

[54] ELEVATOR

[75] Inventor: Hisashi Matsuda, Yokohama, Japan

[73] Assignee: Kabushiki Kaisha Toshiba, Kawasaki, Japan

[21] Appl. No.: 847,305

[22] Filed: Mar. 6, 1992

[30] Foreign Application Priority Data

Mar. 6, 1991 [JP] Japan ..... 3-065449
Aug. 16, 1991 [JP] Japan ..... 3-205733

[51] Int. Cl.[5] ..... B66B 9/00
[52] U.S. Cl. ..... 187/1 R; 52/30
[58] Field of Search ..... 187/1 R, 94; 244/123, 244/130, 138 R; 52/30

[56] References Cited

U.S. PATENT DOCUMENTS 3,945,468 3/1976 Miura et al. ..... 187/1 R
5,080,201 1/1992 Yoo et al. ..... 187/1 R

FOREIGN PATENT DOCUMENTS 50-9571 8/1975 Japan .
50-95751 8/1975 Japan .
52-97536 8/1977 Japan .
57-2362 1/1982 Japan .
57-2364 1/1982 Japan .

*Primary Examiner*—Robert P. Olszewski
*Assistant Examiner*—Kenneth Noland
*Attorney, Agent, or Firm*—Oblon, Spivak, McClelland, Maier & Neustadt

[57] ABSTRACT

In an elevator having an ascending and descending car, the car having side walls for forming the side surfaces of the car, an entrance/exit front wall for allowing a passenger and an article to ride on or alight from the car, a back wall opposed to the entrance/exit front wall, and plate members mounted to extend in the ascending and descending directions of the entrance/exit front wall, further having fairing covers provided to extend in the ascending and descending directions from the side walls and the back wall to be integrated with the plate members and formed in a stream line shape to the ascending and descending directions for suppressing "an accelerating flow" generated along the entrance/exit front wall at the time of ascending and descending, are directions.

22 Claims, 10 Drawing Sheets

ELEVATOR

BACKGROUND OF THE INVENTION 1. Field of the Invention

The present invention relates to an elevator ascending and descending at a high speed and, more particularly, to structures of a car of an elevator for reducing a noise by means of fairing.

2. Description of the Related Art

Recently, as multi-storied buildings to be built have been heightened, the higher acceleration of elevators to be installed in such buildings have also been proceeded. When the speed of elevator car is accelerated faster than approximately 400 m/min, unpleasant noise in the car is increased. The noise in the car at the low speed is known heretofore mainly caused by vibration noise. On the other hand, it is indicated that in the case of the noise in the car at high speed, "aerodynamical noise" essentially including air flow noise due to vortex generated around the car becomes larger than the vibration noise.

One of conventional elevators will be described with reference to FIGS. 13A and 13B and the state of air flows generated around an elevator car will be described.

FIG. 13A is a schematic perspective view of a conventional elevator, and FIG. 13B is an explanatory view showing the state of air flows around the elevator. In FIGS. 13A and 13B, a conventional elevator mainly has a rectangular parallelepiped elevator car 1 disposed vertically movably in a duct provided in a building or the like, a car entrance/exit front wall 2 provided with a car entrance/exit 4 to be opened or closed by a door 3, and sidewalls 5. Further, an apron 6 is mounted at the lower section of the opening wall 2. The apron 6 has a width wider than the width of the entrance/exit 4 for keeping passenger's safety to ride on or alight from the car, and is formed of thin plate having a length of about ½ of the height of the car and mounted to extend downwardly in the vertical direction. Further, a rope 7 and guide rails 8 are provided. The rope 7 is fixed at one end to the car 1 and provided at the other end with "a counter weight", and the rope 7 is driven by a hoisting device (not shown) to vertically move the suspended car 1 along the guide rails 8.

In the conventional elevator constructed as described above, if the car is operated upwardly and downwardly at the same high running speed such as, for example, 420 m/min., larger noise is generated at the time of descending of the car 1 as compared with that at the ascending of the car 1, and the noise level in the car 1 is exceeded by several dBA at the time of descending.

It has been heretofore confirmed that there is a difference at the noise levels between the noise generated at the time of descending and that generated at the time of ascending of the car 1 running at high speed. As concerned with this difference the present inventor has further searched in detail and the following facts have been discovered.

In FIG. 13B, when the car 1 descends in a direction of a thick arrow A, the air at the lower side of the outer wall of the car 1 passes a narrow space between the inner wall of the duct and the car 1 to move to the upper side of the car 1. At this time, vortexes 9 of "horseshoe shape" flowing to enclose the side surface of the car 1 from the lower side are generated in the air flow flowing at the outside of the car 1. It was also confirmed that streamwise vortexes 11 flowing around the side edge 10 extending downstream (upward in the figure) are generated at the lower arpon 6 of the front wall 2 of the car 1. The vortexes 9 of the horseshoe shape extending downstream of the above-described vortexes are normally generated at the air flow around a blunt body. The streamwise vortexes are generated from the fact that by the lower extension plate (apron) extended downwardly the air is stagnated to the lower side of the car so that the air flowed from the lower side of the car to the front surface side of the lower extension plate having lower pressure just to circulate at the side edge. And the streamline of the flow of the air flowing from the back surface side of the lower extension plate is bent by the formation of the streamwise vortexes and forming so-called "contraction flows" and to become local "accelerated flows". The speed of the accelerating flow 12 reached 1.3 times as fast as the running speed of the car 1.

Vortexes 13 of "horseshoe shape" were also generated around guide rails 8 at the sidewalls 5 of the car 1. Further, it has also been discovered that largescale separation bubbles 14 were formed in the vicinity of the sidewalls 5 and the back wall of the car 1 to generate complicated "separation flows".

Since the accelerating flows 12 flow along the front wall 2 having a number of steps such as, the door 3, the entrance/exit 4, a step for riding on or alighting from the car 1 as compared with the sidewalls 5 of the car 1, aerodynamical noise is generated at the front wall 2 due to the steps causing flow disorders. An interval between the inner wall of the duct and the car 1 is narrower than that of the sidewall 5, there is the entrance/exit 4 at the front wall 2, and the entrance/exit 4 is closed by the door 3, but its sealability is not sufficient. Therefore, generated aerodynamical noise is introduced through the interval into the car 1 and enhance the noise level in the car 1. Further, since the front wall 2 has the entrance/exit 4, the door 3 and a mechanism for opening and closing the door 3, it is difficult to enhance its noise shielding performance. As a result, its riding feeling in the car 1 is deteriorated. Further, on the sidewalls and the back wall where the separation bubbles are formed and generate complicated separation flows, aerodynamical noise is generated from in the vicinity of the reattachement regions of the separation flow, then enhance the noise level in the car similarly to the aerodynamical noise due to the accelerating flows.

Since the aerodynamical noise is increased as the ascending and descending speeds of the car are accelerated, noise reduction is further difficult when the ascending and descending speeds of the car are further accelerated.

More specifically, as a result of the oil flow pattern technique experiment by using a model formed in the shape shown in FIG. 13B, it has been cleared that a number of "turbulence" of the (air) flows as shown in FIGS. 14A to 14C (e.g., vortexes) occurred around the car of the conventional elevator. It has also been discovered from the result of the present inventors' experimental analysis that high speed flows called "accelerating flows" were generated in the front wall of the car.

From these experimental results it is supposed that, the main causes of the internal noise of the car of the conventional elevator car were the above-described "turbulence of the (air) flows" and "accelerating flows".

Elevators constituted by providing various "fairing plates" at the upper and/or lower portions of elevator cars to reduce air flowing noise due to vortexes generated around elevator cars are disclosed in Published Unexamined Japanese Patent Application Nos. Sho 45-32569, 50-102043, Published Unexamined Japanese Utility Model Application Nos. Sho 49-46121 and 60-98751.

However, since vertical vortexes are generated at the side edges of fairing plates due to pressure difference between the front surface and the rear surface of the fairing plate in all the prior arts, it is supposed discovered that "accelerating flows" are generated at the front side, i.e., at the front surface side, and aerodynamical noise due to the accelerating flows are increased in the elevator car as the ascending and descending speeds of the car are accelerated.

SUMMARY OF THE INVENTION

The present invention has been made in view of the difficulty in reduction in the aerodynamical noise in an elevator car to occur at the above-described high speed ascending and descending speeds of the car. More specifically, an object of the present invention is to provide an elevator which reduces generation of noise in an elevator car due to aerodynamical noise to be increased mainly by accelerating flows to be generated by high speed ascending and descending speed of the car to realize preferable riding feeling and to reduce noise without problem even if the ascending and descending speeds of the car are further accelerated.

According to the present invention, there is provided an elevator comprising an ascending and descending car, sidewalls for forming the side surfaces of the car, an entrance/exit front wall and a back wall opposed to the entrance/exit front wall, and an apron mounted to extend in the ascending and descending direction of the entrance/exit front wall, wherein the car comprises accelerating flow suppressing means for suppressing an "accelerating flow" generated along the entrance/exit front wall at the time of ascending and descending of the car. More specifically, the accelerating flow suppressing means includes, side plates mounted at the arpon to extend in the ascending and descending directions of the side walls, an arpon provided with a through hole, a back surface apron extending in the ascending and descending directions of the back wall, side plates mounted between the back surface apron and the apron to extend in the ascending and descending directions of the side wall and V-shaped cutouts formed to cut out the side plates in the ascending and descending directions, or a fairing cover provided to extend from the side walls and the back wall in the ascending and descending directions, provided to be integrated with the arpon to be formed in a streamlined shape to the ascending and descending directions.

The elevator constituted as described above comprises side plates or a through hole provided at an apron to extend, for example, in the ascending and descending directions of the side wall to form accelerating flow suppressing means, and a fairing cover formed in a streamlined shape. In the arrangement provided with the side plates, "streamwise vortexes" are generated at the side edges of the side plates by said means and accelerating flows are generated at the side walls to suppress "accelerating flows along the entrance/exit front wall. In the arrangement provided with the through hole, the "accelerating flows" along the entrance/exit front wall are suppressed so as not to generate vertical vortexes by the apron. In the arrangement provided with the fairing cover, smooths flows are generated to suppress "separation flows" and "accelerating flows" without generating the streamwise vortexes. As a result, aerodynamical noise generated by the accelerating flows are reduced to reduce noise in the elevator car at the time of high speed ascending and descending. Therefore, the passenger's riding feeling can be improved, and the present invention can be applied to elevators to be accelerated at the ascending and descending speeds of the cars in response to the heightened multi-storied buildings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

First Embodiment

Figure 1:
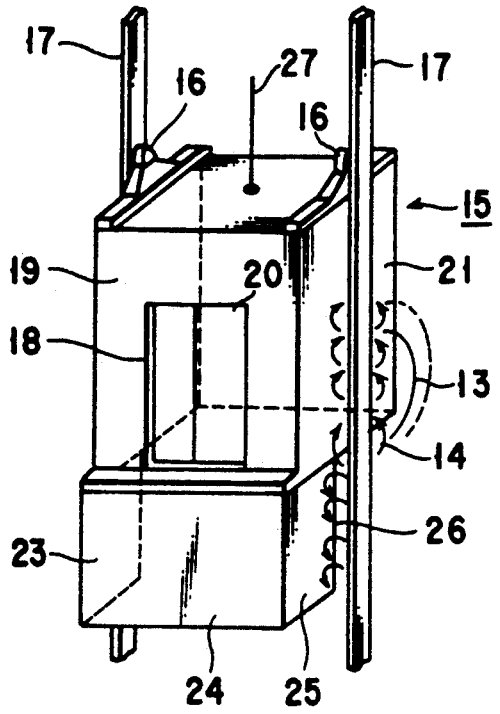
FIG. 1 is a schematic perspective view showing a first embodiment of an elevator of the present invention and air flows generated around an elevator car.

A first embodiment of an elevator of the present invention will now be described with reference to FIG. 1. In FIG. 1, a car 15 ascending and descending in a duct provided in a building or the like is formed, for example, in a rectangular parallelepiped shape having, for example, about 2 m of one side of a front surface and about 3 m of height. Guide shoes 16 are mounted at the car 15. The guide shoes 16 are guided along guide rails 17 stood in the duct to ascend or descent the car 15. An entrance/exit front wall 19 opened with an entrance/exit 18 for allowing a passenger to ride on or alight from the car 15 at a predetermined floor at one side surface of the car 15. An openable door 20 is mounted at the entrance/exit 18. On the other hand, the other side surfaces are surrounded by side walls 21 and a back wall 22.

The feature of the first embodiment is that a lower arpon 23 for forming a car floor apron formed in a ⊔-shaped section of horizontal direction is mounted to extend downwardly of ascending and descending directions at the lower portion of the front side of the car 15. The lower arpon 23 is formed of a rectangular front surface plate 24 and rectangular side plates 25. The front surface plate 25 is mounted to extend downwardly at the lower portion of the entrance/exit front wall 19. The side plates 25 are provided adjacent to both sides of the front surface plate 24, and mounted to extend downwardly in predetermined width partly at the lower portion of the two side walls 21 and 21 adjacent to the entrance/exit front wall 19. Side edges 26 are formed at the side plates 26 extending downwardly from the intermediate portions of the bottoms of the side walls 21. The lower arpon 23 is formed of a thin plate having about 1.5 m of length in ascending and descending directions.

The car 15 is suspended to be supported by a rope 27 fixed at one end to the top of the car 15. A counter weight (not shown) is supported to be suspended through a hoisting device (not shown) from the other end of the rope 27. The rope 27 is driven by the hoisting device to ascend or descend the car 15 and the counter weight at a predetermined running speed.

In the first embodiment constituted as described above, the car is operated to be ascended and descended at the same running speed (e.g., 420 m/min. of high speed). Particularly, in the case of descending operation, "vortexes of horseshoe shape" flowing to enclose the side surfaces of the car 15 from the lower side are generated at the outside of the car 15 similarly to the prior art. Since the air is fed out to be circulated outwardly at the side edges 2 of the side plates 25 from the lower side of the car 15 by the air stagnated to the lower side of the car 15 by the lower arpon 23 extended downwardly to be raised under pressure, "streamwise" vortexes" are generated at the side edges 26. Upward "accelerating flows" are generated at the side surfaces of the side plates 2 and the side walls 21 by the streamwise vortexes. On the other hand, accelerating flow is not generated at the front surface side of the front surface plate 24 and the entrance/exit front wall 19.

Therefore, aerodynamical noise due to such accelerating flow caused by such accelerating flows is not observed at the entrance/exit front wall 19. The side walls 21 is generally formed in a flat state relatively without step at the side walls 21 for generating the accelerating flows. an interval to the inner wall of the duct is largely obtained, and noise level of aerodynamical noise generated by the accelerating flow is low. Further, since the noise of the low level thus generated is generated at farther portion from the portion of the entrance/exit 18, noise in the car 15 is not increased even by the equivalent sound shielding performance to that of the prior art.

Therefore, the noise level in the car 15 in the case of descending operation become the same degree as that of the case of the ascending operation, and passenger's riding feeling can be improved while maintaining passenger's safety. Therefore, according to this first embodiment, the ascending and descending of the car at higher speed can be performed without deteriorating the passenger's riding feeling, and the ascending and descending speeds of the car can be accelerated in response to the heightened multi-storied building.

Second Embodiment

Figure 2:
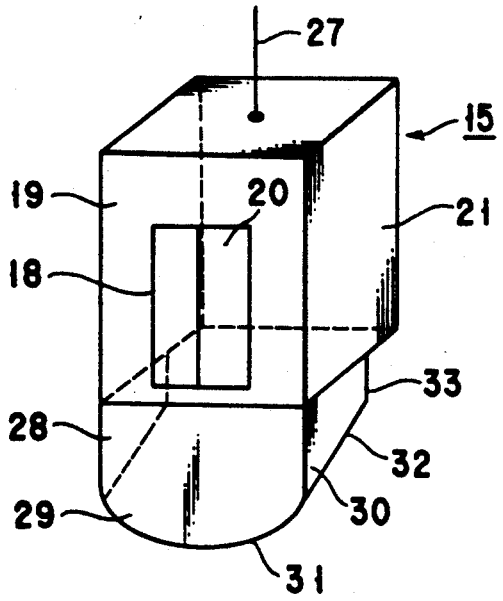
FIG. 2 is a schematic perspective view showing a second embodiment of an elevator of the present invention.

Then, a second embodiment of an elevator of the present invention will be described with reference to a schematic perspective view of FIG. 2. In FIG. 2, a lower apron 28 is formed in ⊔-shaped section of a horizontal direction at a position 28, and mounted at the lower portion of the front side of a car 15. The lower apron 28 is formed of a thin plate, and comprises a front surface plate 29 and side plates 30 provided adjacently to both sides of the front surface plate 29. The lower apron 28 is mounted to extend the front surface plate 29 downwardly at the lower portion of an entrance/exit front wall 19, and the side plates 30 are mounted to extend downwardly in a predetermined width partly at the lower portions of the two side walls 21 and 21 adjacent to the entrance/exit front wall 19. Further, the features of the second embodiment are that the lower edge of the lower apron 28 is formed at the lower edge 31 of the front surface plate 29 in a circular-arc shape, the lower edges 32 of the side plates 30 are connected to the lower edges 31 of the front surface plate 29, and the length of the lower direction is gradually reduced toward the side edges 33.

In the second embodiment constituted as described above, when the car is operated similarly to the first embodiment at a high speed and particularly descended, the air stagnated to the lower side of the car 15 to be raised under pressure by the lower apron 28 extending downwardly flows to be circulated outwardly from the lower side of the car 15 to the side edges 33 of the side plates 30 and the inclined lower edge 32. Therefore, vertical vortexes are generated at the side edges 33 and the lower edges 32. Upward "accelerating flows" are generated at the side surfaces of the side plates 30 and the side walls 21 by the vertical vortexes, but accelerating flow is not generated at the front surface sides of the front surface plate 29 and the entrance/exit front wall 19.

Therefore, the same operation and effect as or more than those of the first embodiment are obtained even in this second embodiment.

Third Embodiment

Figure 3A:
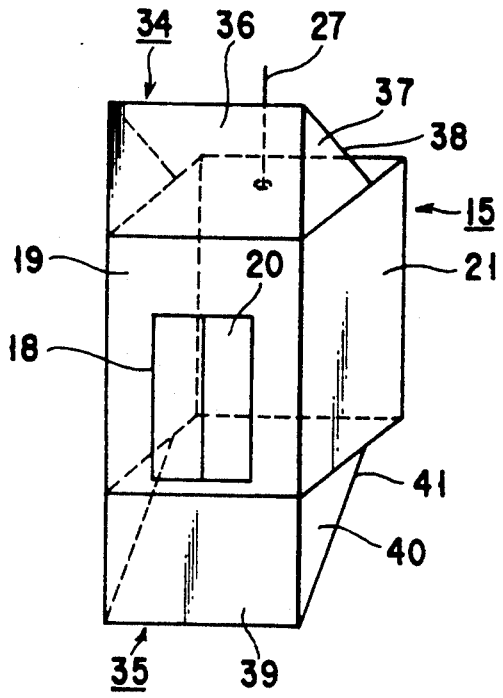
FIG. 3A is a schematic perspective view showing a third embodiment of an elevator or the present invention.

Then, a third embodiment of an elevator of the present invention will be described with reference to a schematic perspective view of FIG. 3. In FIG. 3, the features of the present invention are that an upper apron 34 is mounted at the upper portion of the front side of a car 15, and a lower apron 35 is mounted at the lower portion of the front side of the car 15.

The upper apron 34 is an upper fairing plate provided to reduce variations in air flows at the time of ascending forwardly of the car 15, formed by bending a trapezoidal thin plate in a ⊔ -shape, and comprises a rectangular upper front surface plate 36, and right angle triangular plates 37 provided adjacently to both sides of the upper front surface plate 36. The upper front surface plate 36 is mounted to extend upwardly at the upper portion of an entrance/exit front wall 19, and the upper side plates 37 are mounted to extend upwardly at the upper portions of the two side walls 21 and 21 adjacent to the entrance/exit front wall 19. Upper edges 38 are inclined toward the insides of the upper side plates 27.

The lower apron 36 is formed similarly to the upper apron 34. A lower front surface plate 39, lower side plates 40 and the lower edges 41 of the lower side plates 40 are disposed as shown in FIG. 3. The lower front surface plate 39 is mounted to extend downwardly at the lower portion of the entrance/exit front wall 19, and the lower side plates 40 are mounted to extend downwardly at the lower portions of two side walls 21 and 21 adjacent to the entrance/exit front wall 19.

In the third embodiment constituted as described above, when the car 15 is operated at a high speed and descended similarly to the first embodiment, the air stagnated to the lower side of the car 15 by the lower apron 35 extended downwardly to be raised under pressure is fed to be circulated outwardly at the inclined lower edges 41 of the lower side plates 40 from the lower side of the car 15 to generate streamwise vortexes at the lower edges 41. Upward accelerating flows are generated at the side surfaces of the lower side plates 40 and the side walls 21 by the streamwise vortexes. However, accelerating flows ar not generated at the front surface sides of the lower front surface plate 39 and the entrance/exit front wall 19.

Further, in the case of ascending operation, the air stagnated to the upper side of the car 15 by the upper apron 34 extended upwardly to be raised under pressure is fed to be circulated outwardly at the inclined edges of the upper side plates 37 from the upper sides of the car 15 similarly to the case of descending operation different in the direction, thereby generating streamwise vortexes at the upper edges 38. Downward accelerating flows are generated at the side surfaces of the upper side plates 37 and the side walls 21 by the streamwise vortexes, but accelerating flow is not generated at the front surface sides of the upper front surface plate 36 and the entrance/exit front wall 19.

Therefore, even in the third embodiment, the same operation and effect as those or more than those of the above respective embodiments are obtained. Since fairing upper apron 34 is provided at the upper portion of the car 15, an effect of reducing the turbulence of the air flow generated around the ca 15 at the time of ascending, and particularly reducing variations in the air flow at the entrance/exit front wall 19 is provided, thereby suppressing the noise level in the car 15 even if ascending and descending speeds of the car 15 are accelerated.

Figure 3B:
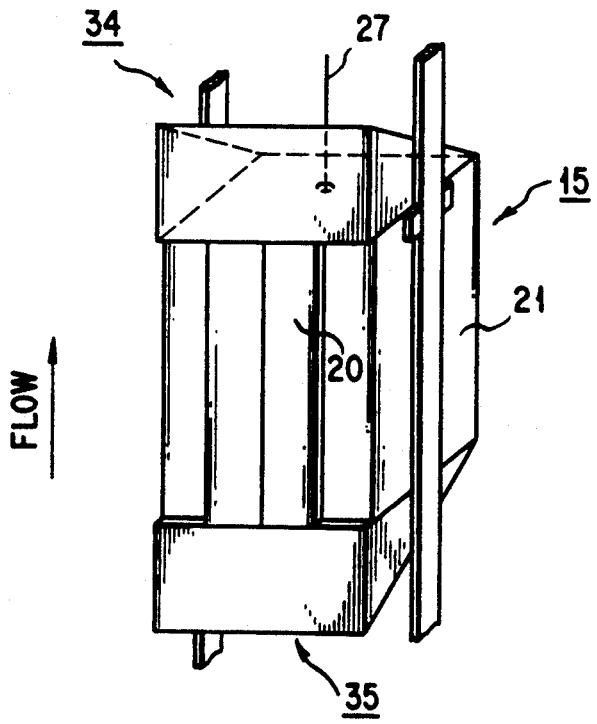
FIG. 3B is a perspective view as seen upwardly from below of the third embodiment.
Figure 4A:
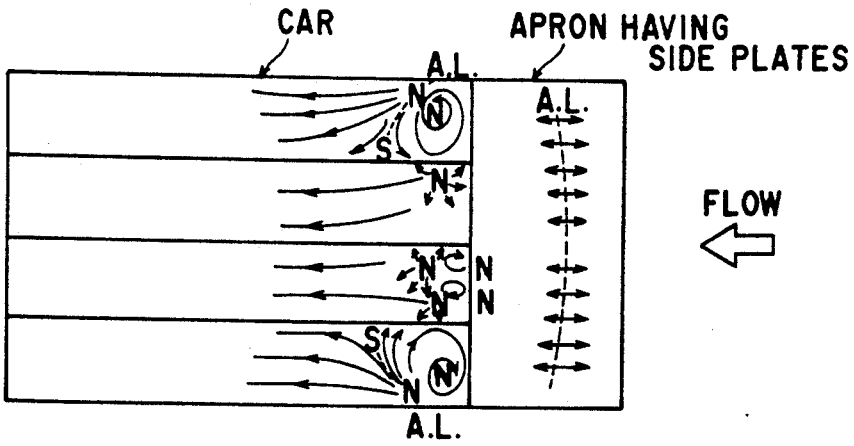
FIG. 4A is a front flow diagram of the car of the elevator of FIG. 3B.
Figure 4B:
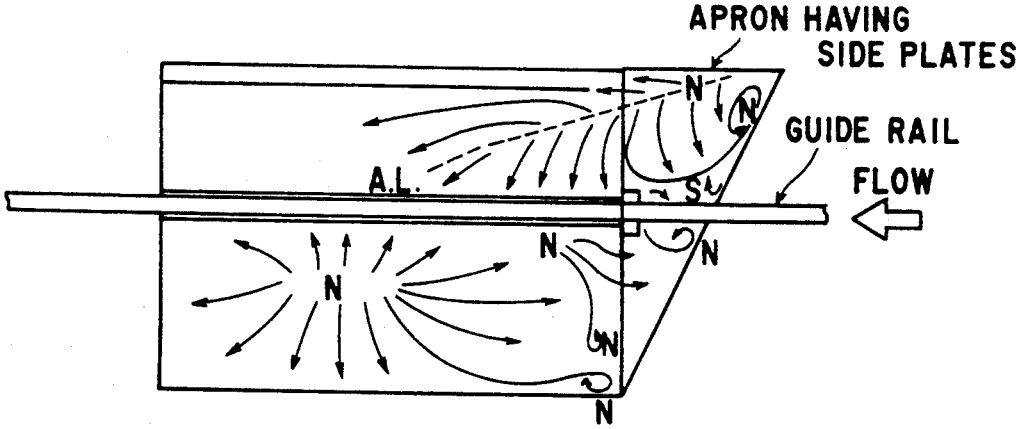
FIG. 4B is a side flow diagram of the car of the elevator of FIG. 3B.
Figure 4C:
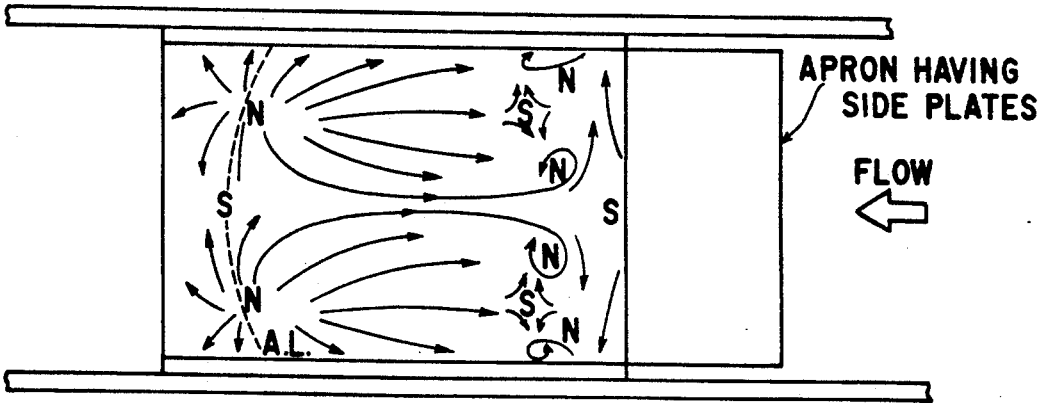
FIG. 4C is a back flow diagram of the car of the elevator of FIG. 3B.
Figure 13A:
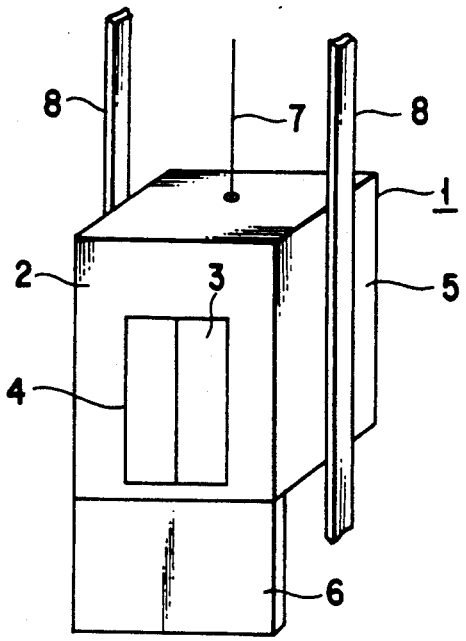
(PRIOR ART) FIG. 13A
FIG. 13A is a schematic perspective view of prior art.
Figure 13B:
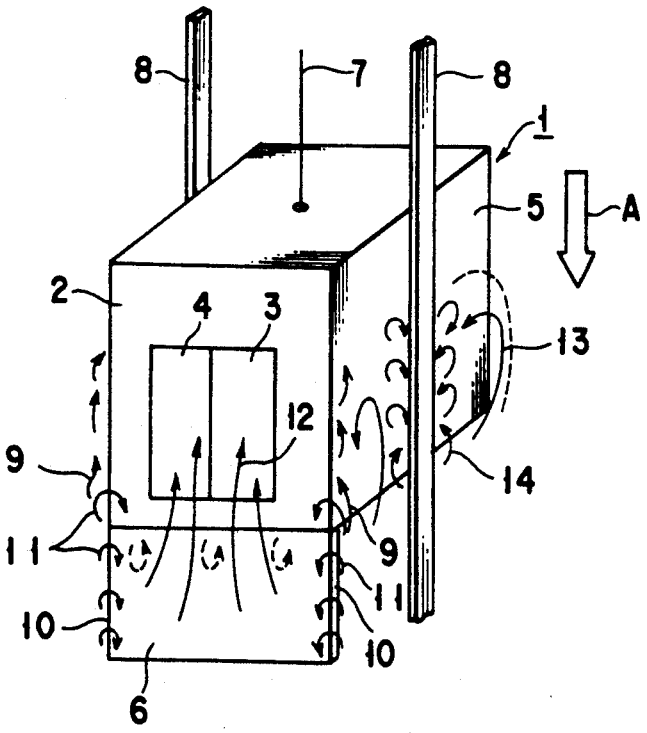
(PRIOR ART) FIG. 13B
FIG. 13B is a perspective view schematically showing air flows generated around the car of the elevator of FIG. 13A
Figure 14A:
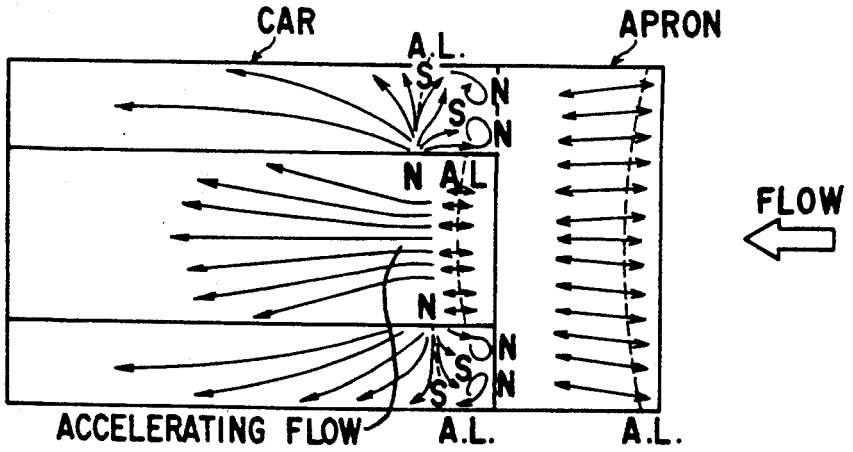
(PRIOR ART) FIG. 14A
FIG. 14A is a front flow diagram of the car of the conventional elevator of FIG. 13B.
Figure 14B:
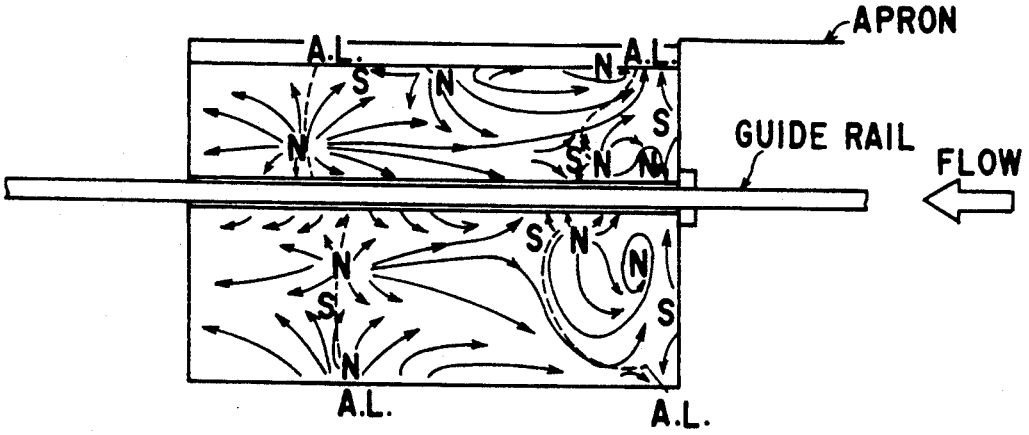
(PRIOR ART) FIG. 14B
FIG. 14B is side flow diagram of the car of the conventional elevator of FIG. 13B.
Figure 14C:
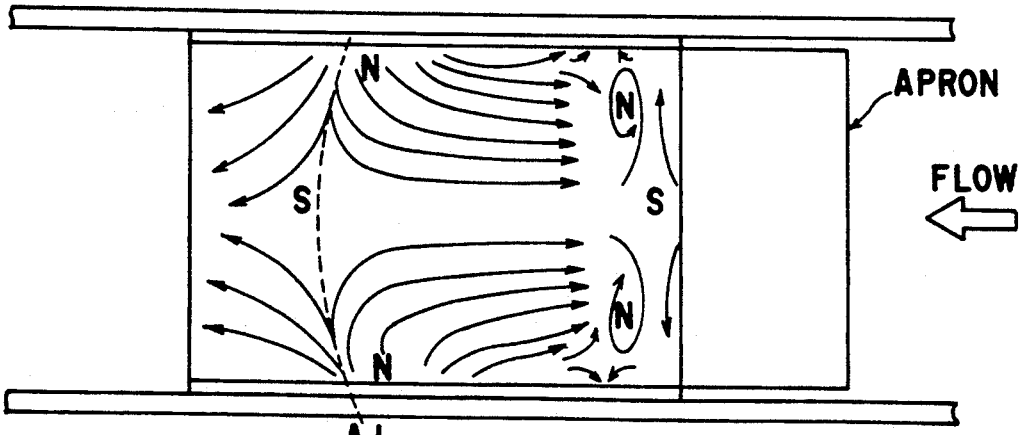
(PRIOR ART) FIG. 14C
FIG. 14C is a back flow diagram of the car of the conventional elevator of FIG. 13B.

More specifically, as a result of the oil flow pattern turbulence by using a model formed in shape of an actual size shown in FIG. 3B, the (air) flows generated around the car are compared with the results of the conventional elevator showing in FIG. 13A. That is, in the case of the third embodiment, as shown in FIGS. 4A to 4C, (air) flows are generated. Comparing with (FIGS. 14A to 14C showing) experimental results of FIG. 13A showing the conventional example, it is understood that the "turbulence of the (air) flow" (e.g., vortexes) of the case of this embodiment is rare particularly on the surface of the car. The accelerating flow generated remarkably in the conventional elevator is not generated or reduced.

Generally, aerodynamical noise increases in proportion of the car 15 by a plurality of the through holes 43 formed at the lower apron 42, no stagnation occurs. Therefore, streamwise vortex is not generated at the side edge of the lower apron 42. As a result, accelerating flow is not generated at the front surface side of the entrance/exit front wall 19.

Therefore, even if the ascending or descending speed is accelerated, aerodynamic noise due to the accelerating flow in the car 15 is not generated. Since the holes 43 formed at the lower apron 42 have small diameters, passenger's safety is maintained.

Fifth Embodiment

Figure 6:
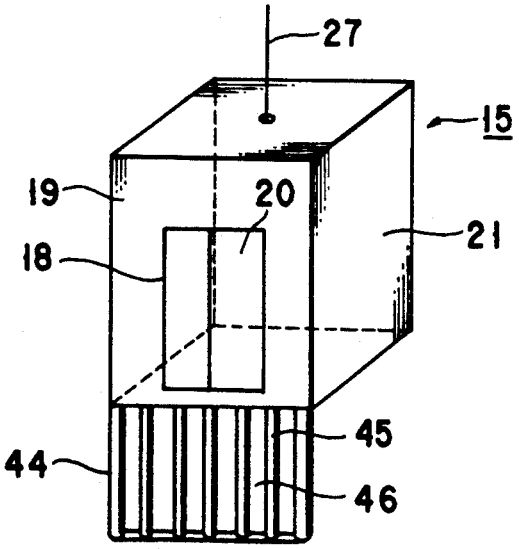
FIG. 6 is a schematic perspective view showing a fifth embodiment of an elevator of the present invention.

Then, a fifth embodiment of an elevator of the present invention will be described with reference to a schematic perspective view of FIG. 6. In FIG. 6, the feature of this embodiment is that a lower apron 44 mounted to extend downwardly is provided at the lower portion of an entrance/exit front wall 19. The lower apron 44 comprises a plurality of slender rods 45 aligned at a predetermined interval in parallel in ascending and descending directions, associated in a frame, and rectangular through holes 46 are formed between the slender rods 45.

Even in the embodiment constructed as described above, when the car is descended similarly to the fourth embodiment, the air fed to the lower side of the car 15 is fed through the through holes 46 to the entrance/exit front wall 19 side to the front surface side of the entrance/exit front wall 19, and not stagnated. No streamwise vortex is generated at the side edges of the lower apron 44. Therefore, accelerating flow is not generated at the front surface side of the entrance/exit front wall 19, and the same operation and effect as those of the fourth embodiment of FIG. 6 are obtained.

Sixth Embodiment

Figure 7:
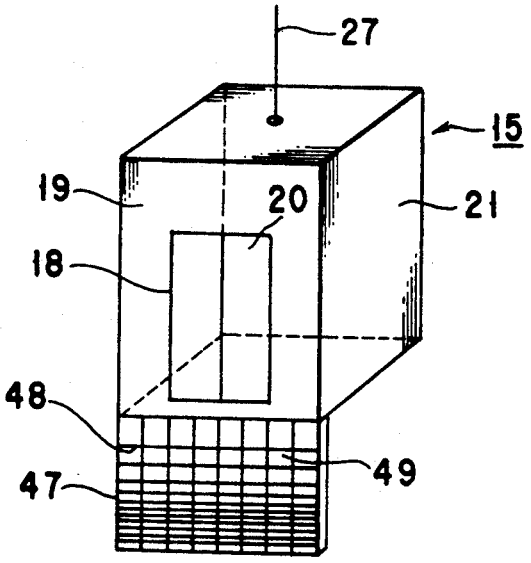
FIG. 7 is a schematic perspective view showing a sixth embodiment of an elevator of the present invention.

Then, a sixth embodiment of an elevator of the present invention will be described with reference to a schematic perspective view of FIG. 7. In FIG. 7, the feature of this embodiment is that a lower arpon 47 mounted to extend downwardly is provided at the lower portion of an entrance/exit front wall 19. The lower apron 47 is formed to associate slender rods 48 in a lattice state to be associated so that the opening ratio is larger toward the car 15, and a number of through holes 49 are formed on the entire surface.

Figure 5:
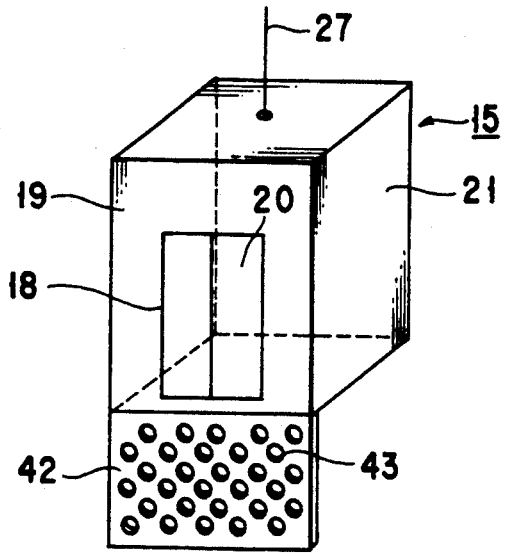
FIG. 5 is a schematic perspective view showing a fourth embodiment of an elevator of the present invention.

In the sixth embodiment constituted as described above, when the car is descended similarly to the fourth embodiment, the air fed to the lower side of the car 15 is fed through the through holes 49 at the entrance/exit front wall 19 side to the front surface side of the entrance/exit front wall 19, and not stagnated. No streamwise vortex is generated at the side edges of the lower apron 47. Therefore, accelerating flow is not generated at the front surface side of the entrance/exit front wall 19, and similar operation and effect to those of the embodiment in FIG. 5 are obtained. Since the lower apron 47 is formed so that the opening ratio is increased toward the car 15 side, it is more effective to prevent stagnation of the air.

Seventh Embodiment

Figure 8:
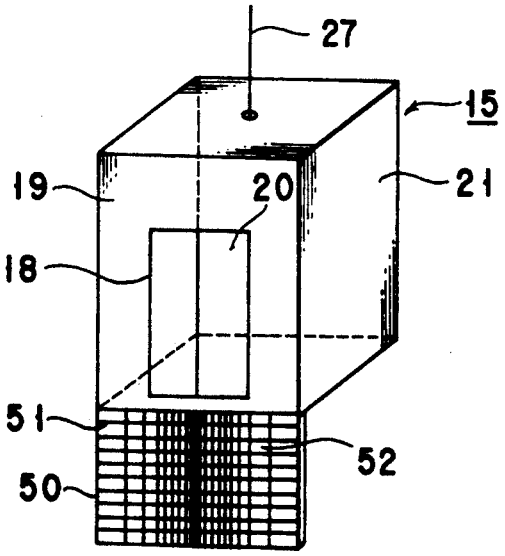
FIG. 8 is a schematic perspective view showing a seventh embodiment of an elevator of the present invention.

Then, a seventh embodiment of an elevator of the present invention will be described with reference to a schematic perspective view of FIG. 8. In FIG. 8, the feature of this embodiment is that a lower apron 50 mounted to extend downwardly is provided at the lower portion of an entrance/exit front wall 19. The lower apron 50 is formed to associate slender rods 51 in a lattice state to be associated so that the opening ratio is larger toward the side edge, and a number of through holes 52 are formed on the entire surface.

In the seventh embodiment constituted as described above, when the car is descended similarly to the fourth embodiment, the air fed to the lower side of the car 15 is fed through the through holes 52 at the entrance/exit front wall 19 side to the front surface side of the entrance/exit front wall 19, and not stagnated. No streamwise vortex is generated at the side edges of the lower apron 50. Therefore, accelerating flow is not generated at the front surface side of the entrance/exit front wall 19, and similar operation and effect to those of the embodiment in FIG. 5 are obtained. Since the lower apron 50 is formed so that the opening ratio is increased toward the lower edge, it is more effective to prevent streamwise vortex of the air.

Eighth Embodiment

Figure 9:
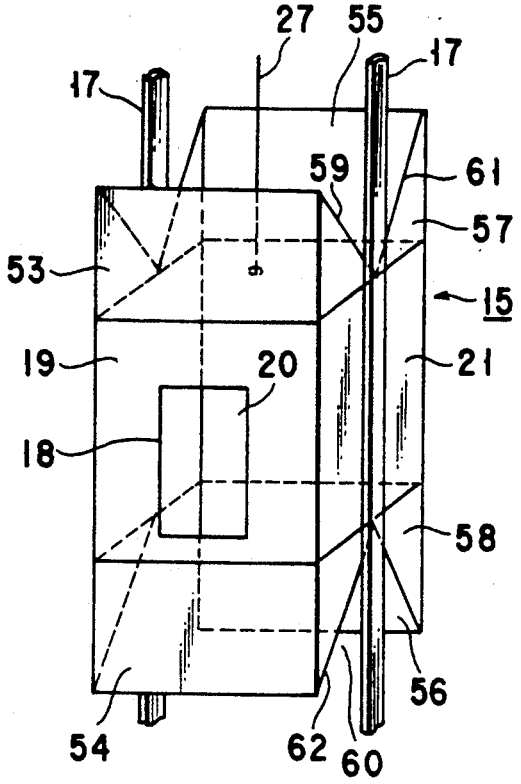
FIG. 9 is a schematic perspective view showing a eighth embodiment of an elevator of the present invention.

Then, an eighth embodiment is shown in a schematic perspective view of FIG. 9. In FIG. 9, the features of this embodiment are that an upper apron 53 and a lower apron 54 are formed of rectangular thin plates, and respectively mounted to extend upwardly and downwardly toward an entrance/exit front wall 19. Further, an upper back surface apron 55 and a lower back surface apron 56 are respectively mounted to extend upwardly and downwardly at a back wall 22. Upper side plates 57 are mounted to extend downwardly at the tops of both the side walls 21 and 21 between the upper apron 53 and the lower back surface apron 55. Further, lower side plates 58 are mounted to extend downwardly at the lower portions of both the side walls 21 and 21 between the lower apron 54 and the lower back surface apron 56. The upper apron 53 is an upper fairing plate provided to reduce variations in the air flow at the time of ascending forwardly of the car 15.

The upper side plates 57 and the lower side plates 58 are formed with V-shaped upper cutouts 59 and lower cutouts 60 having vortexes on the center line of the ascending and descending directions of the side walls 21. Both the cutouts 59 and 60 have vortexes smaller than 100 degrees so that the bisecting line of the vertex coincide with the ascending and descending directions. Reference numeral 61 denotes the inclined upper edge of the upper cutout 59, and reference numeral 62 denotes the inclined upper edge of the lower cutout 60.

In the eighth embodiment constituted as described above, when the car is operated at a high speed and descended similarly to the first embodiment, the air stagnated to the lower side of the car 15 by the lower apron 54, the lower back surface apron 56 and the lower side plates 58 extending downwardly to be raised under pressure is fed to be circulated outwardly at the inclined lower edge 62 of the lower cutout 60 of the lower side plates 58 from the lower side of the car 15 to generate vertical vortexes along the lower edge 62. Upward accelerating flow is generated by the lower side plates 58 and the side walls 21 by the vertical vortexes. However, accelerating flow is not generated at the front surface side of the lower apron 54 and the entrance/exit front wall 19. Since the vertex of the lower cutout 60 is formed at an angle smaller than 100 degrees, the interference of the streamwise vortexes generated at the edge (separation vortex generating region) can be concentrated in the vicinity of the vertex, and the reattachement region of the separation flow can be concentrated in the vicinity of the lower cutout 60.

In the case of ascending operation, the direction is different from that of the case of descending operation as described above, but the air stagnated to the upper side of the car 15 by the upper apron 53, the upper back surface apron 55 and the upper side plates 57 extending upwardly to be raised under pressure is similarly fed to be circulated outwardly at the inclined upper edge 61 of the upper cutout 59 of the upper side plate 57, thereby generating streamwise vortexes along the upper edge 61. However, accelerating flow is not generated at the front surface side of the upper apron 53 and the entrance/exit front wall 19. Since the vertex of the upper cutout 59 is set to an angle smaller than 100 degrees, the interference region of the streamwise vortex generated at the edge (generating region of separation vortexes) can be concentrated in the vicinity of the vertex, and the reattachement region of the separation flow can be also concentrated in the vicinity of the upper cutout 59.

Therefore, even in the eighth embodiment, the same or more operation and effect as or than those of the above-described respective embodiments are obtained. Further, fairing upper apron 53 and upper side plates 57 are provided at the upper portion of the car 15, the noise level in the car 15 can be suppressed to low value even if the car 15 is accelerated while reducing the turbulence of the air flow generated around the car 15 at the time of ascending and particularly the flactuations in the air flow at the entrance/exit front wall 19. Further, since the upper cutout 59 and the lower cutout 60 are provided and separation vortex generating region and separation flow reattachement region are concentrated in the vicinity of the cutouts 59, 60, an aerodynamical noise source upon separation flow can be easily formed in noise shielding structure. Therefore, since the source can be specified at the farther position from the entrance/exit 18, the noise level in the car 15 can be suppressed to a lower level than that of the conventional elevator even in the case of high speed operation. Since the upper and lower back surface apron 55, 56 are provided on the back surface side, when an interval between the ascending and descending duct and the back surface side of the car 15 is narrow or an entrance/exit is provided also at the back surface side, variations in the air at the time of high speed ascending or descending can be reduced, thereby reducing aerodynamical noise.

Ninth Embodiment

Figure 10:
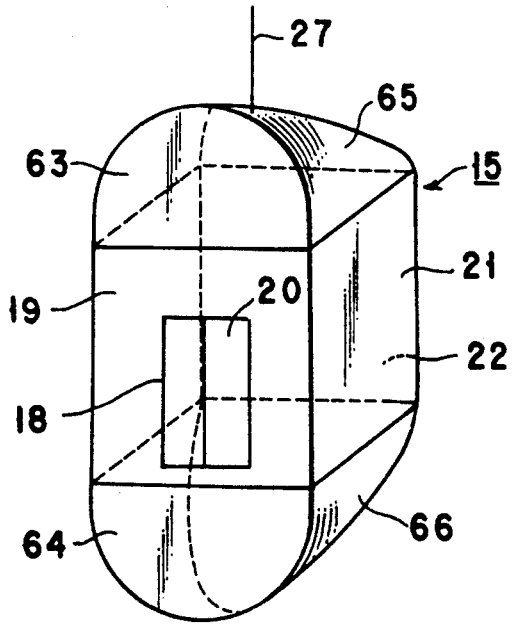
FIG. 10 is a schematic perspective view showing a ninth embodiment of an elevator of the present invention.

Then, an ninth embodiment is shown in a schematic perspective view of FIG. 10. In FIG. 10, the features of this embodiment are that an upper apron 63 and a lower apron 64 are formed of thin plates respectively mounted to extend upwardly and downwardly toward an entrance/exit front wall 19, and upper and lower edges are formed in circular-arc shape. Further, an upper fairing cover 65 and a lower fairing cover 66 are respectively formed in dome shape having smoothly curved surfaces with openings at the front surface side and the side of ascending and descending directions. Further, both the side walls 21, 21 of the car 15 are smoothly connected to the back wall 22 by the opening of the surface side of ascending and descending directions, and mounted so that the openings of the surface of ascending and descending directions are integrated with the circular-arc-shaped edges of the upper apron 63 and the lower apron 64. The upper and lower portions of the car 15 are covered with the integral structure of the streamline shapes of the upper and lower apron 63 and 64, and the upper and lower fairing covers 65 and 66.

In the ninth embodiment constituted as described above, when the car is operated at a high speed and descended similarly to the first embodiment, the air is not stagnated to the lower portion of the car 15 and large-scale separation is not generated but smoothly fed upwardly since the lower fairing cover 66 of streamlined shape is mounted to integrate the lower apron 64 extending downwardly at the lower portion of the ca 15. Therefore, local accelerating flow is not generated, and separation flow in the vicinity of the side walls 21 and the back wall 22 can be suppressed. In the case of ascending, local accelerating flow is eliminated and separation flow in the vicinity of the side walls 21 and the back wall 22 can be suppressed similarly to the case of ascending different in the direction from that of the case of descending since the upper fairing cover 64 of streamline shape is mounted to integrate with the upper apron 63 extending upwardly at the upper portion of the car 15.

Therefore, even in the ninth embodiment, the same or more operation and effect as or than those of the above-described respective embodiments are obtained for the accelerating flow. Separation flow can be suppressed to reduce aerodynamic noise can be reduced, and even if the speed of the car is accelerated, noise level in the car 15 can be reduced.

Tenth Embodiment

Figure 11A:
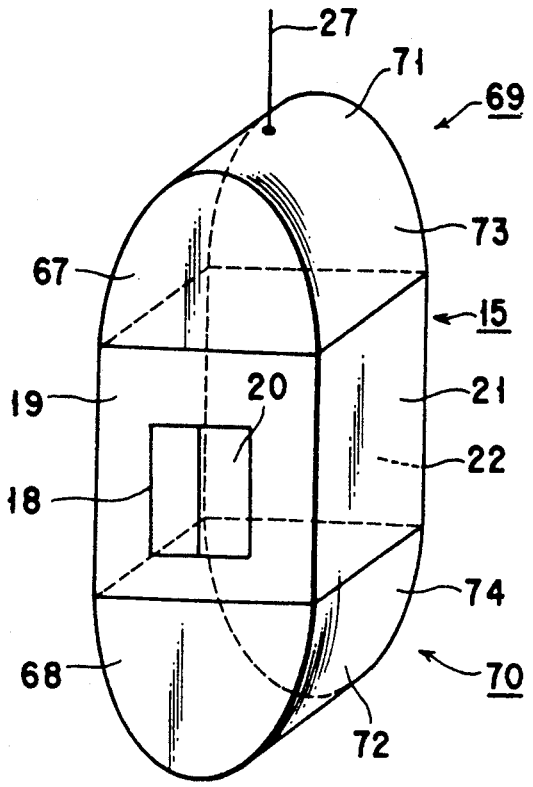
FIG. 11A is a schematic perspective view showing a tenth embodiment of an elevator of the present invention.

Then, an tenth embodiment is shown in a schematic perspective view of FIG. 11. In FIG. 11, the features of this embodiment are that an upper apron 67 and a lower apron 68 are formed of semielliptical thin plates respectively mounted to extend upwardly and downwardly toward an entrance/exit front wall 19. Further, an upper fairing cover 69 and a lower fairing cover 70 are respectively formed in trapezoidal elliptical shape. An upper back surface plate 71 and a lower back surface plate 72 of the same shape as those of the upper and lower apron 67 and 68 are provided at the radial one ends, and an upper plate 73 and a lower plate 74 bent in a circular arc shape along the edges of both the back surface plates 71, 72 are provided on the periphery. Openings are formed at the front surface side of the other radial end and the trapezoidal surface of the ascending and descending directions. Further, the upper and lower fairing covers 69 and 70 are smoothly connected to both the side walls 21, 21 and the back wall 22 of the car 15 at the opening of the ascending and descending directions, and mounted to integrate the opening of the front surface side with the edges of the upper and lower apron 67, 68. The upper and lower portions of the car 15 are covered with the upper and lower fairing covers 69, 70 to form a streamline integral structure. Even in the tenth embodiment constituted as described above, in the case of descending and ascending at a high speed similarly to the ninth embodiment, the same or more operation and effect as or than those of the ninth embodiment are obtained for the accelerating flow and separation flow. Since the upper and lower back surface plates 71, 72 are provided on the back surface side similarly to the upper and lower apron 67, 68 of the entrance/exit front wall 19, if the interval between the ascending and descending duct and the back surface side of the car 15 is narrow, or if the entrance/exit is provided at the back surface side, variation in the air at the time of ascending and descending at a high speed can be reduced, and aerodynamical noise can be reduced.

Figure 11B:
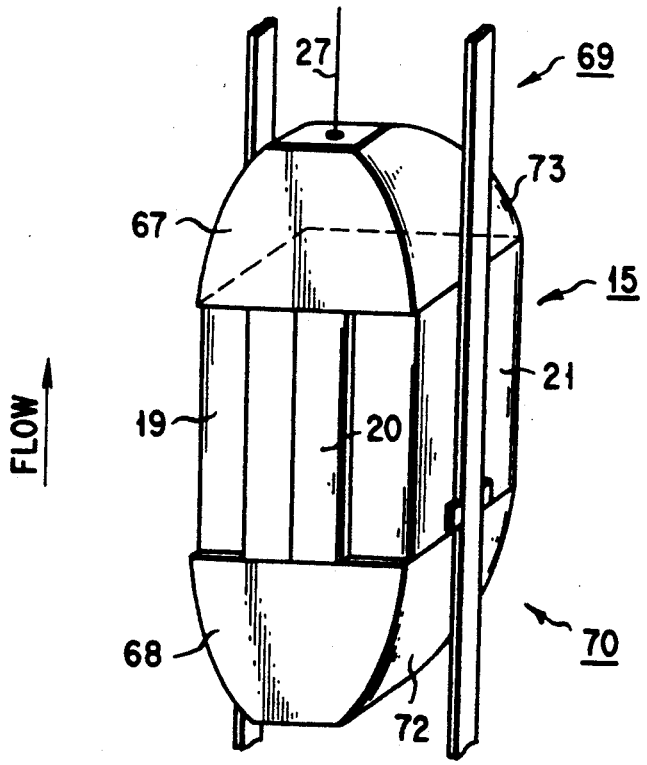
FIG. 11B is a perspective view as seen upwardly from below of the tenth embodiment.
Figure 12A:
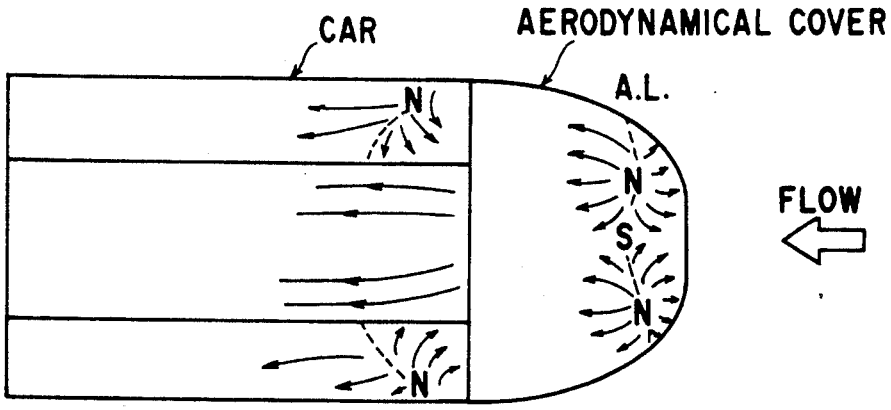
FIG. 12A is a front flow diagram of the car of the elevator of FIG. 11B.
Figure 12B:
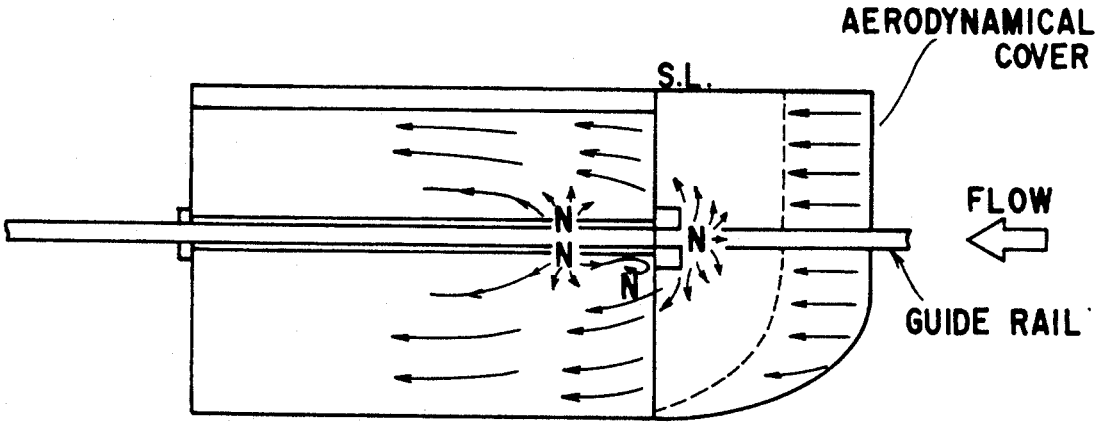
FIG. 12B is a side flow diagram of the car of the elevator of FIG. 11B.
Figure 12C:
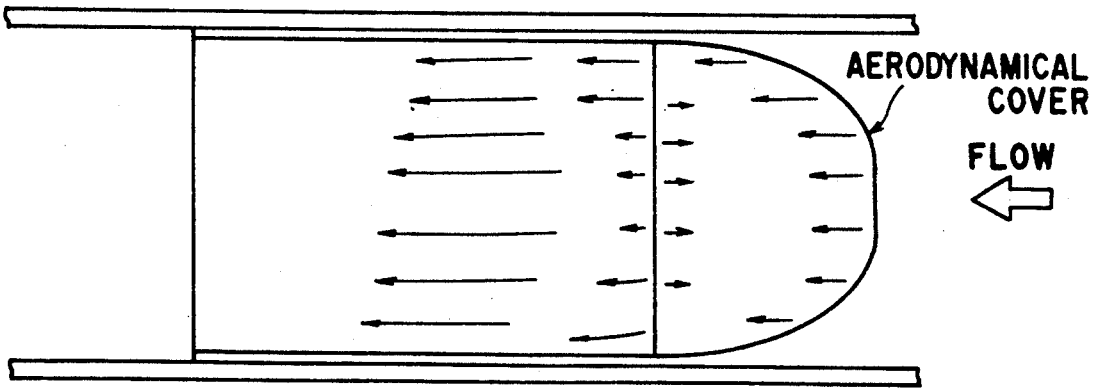
FIG. 12C is a back flow diagram of the car of the elevator of FIG. 11B.

More specifically, as a result of the oil flow pattern technique by using a model formed in shape shown in FIG. 11B, the (air) flows generated around the car are compared with the results of the conventional elevator. That is, in the case of the third embodiment, as shown in FIGS. 12A to 12C, (air) flows are generated, and in comparison with (FIGS. 14A to 14C showing) simulation results of FIG. 13A showing the conventional example, it is understood that the "turbulence of the (air) flow" (e.g., vortexes) of the case of this embodiment is almost completely eliminated particularly on the surface of the car Accelerating flow generated remarkably in the conventional elevator is not generated.

Therefore, the shape of the car of this embodiments has been proved to be the most effective of the present invention, and the excellent noise reduction efficiency is proved by the above-described simulation.

The present invention is not limited to the particular embodiment shown in the drawings and described above. Various modifications may be made without departing from the spirit or scope of the general inventive concept as defined by the appended claims and their equivalents.

As apparent from the above description, the elevator of the present invention comprises the accelerating flow suppressing means for suppressing the accelerating flow generated along the entrance/exit front wall of the car to reduce noise in the car due to aerodynamical noise generated at ascending and descending speeds at a high speed, to improve passenger's riding feeling and to accelerate the ascending and descending speeds of the car in heightened multi-storied building.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An elevator having an ascending and descending car, said car comprising an entrance/exit front wall for allowing a passenger and an article to ascent and descent, side walls for forming both sides of said entrance/exit front wall, a back wall opposed to said entrance/exit front wall, and a plate member mounted to extend in ascending and descending directions of said entrance/exit front wall, wherein said car further comprises a back surface plate member provided to extend in ascending and descending directions of said back wall, integrally mounted with said plate member for suppressing "an accelerating flow" generated along said entrance/exit front wall at a time of ascending and descending, and side plates mounted to extend in ascending and descending directions of said side walls, said side plates formed with V-shaped cut-outs formed to cut out in the ascending and descending directions.

2. An elevator comprising:

an ascending and descending car, said car having an entrance/exit front wall for allowing a passenger and an article to ascend and descend, side walls for forming both sides of said entrance/exit front wall, and a back wall opposed to said entrance/exit front wall;

a plate member mounted to extend in at least descending direction of said entrance/exit front wall, one side of which is mounted to said car, and which is formed to be flat from said one side to a front end of another side; and accelerating flow suppressing means integrally mounted with said car for suppressing an accelerating flow generated along said entrance/exit front wall at a time of ascending and descending, wherein said accelerating flow suppressing means includes a side plate mounted to both said plate member and said car, the mounting portion between said side plate and said plate member being extended to a position equivalent to the front end of said plate member.

3. The elevator according to claim 2, wherein said side plate is integrally mounted with said plate member.

4. The elevator according to claim 2, wherein the front end of said another side of said plate member is formed in a U-shape in ascending and descending directions.

5. The elevator according to claim 2, wherein another plate member similar to said plate member is provided, and each of said two plate members extends in ascending or descending directions of said car respectively, and said accelerating flow suppressing means is mounted in each of said plate members.

6. An elevator comprising:

an ascending and descending car, said car having an entrance/exit front wall for allowing a passenger and an article to ascend and descend, side walls for forming both sides of said entrance/exit front wall, and a back wall opposed to said entrance/exit front wall;

a plate like member mounted to extend in at least descending direction of said entrance/exit front wall, one side of which is mounted to said car; and pressure adjusting means for reducing a pressure difference between the sides of said entrance/exit front wall and of said back wall of said plate like member at a time of ascending and descending.

7. The elevator according to claim 6, wherein said pressure adjusting means are through holes formed in said plate like member.

8. The elevator according to claim 6, wherein said plate like member is comprised of a plurality of pillar-shaped members having a space between adjacent ones thereof, and said pressure adjusting means is comprised of said spaces.

9. The elevator according to claim 6, wherein said plate like member is comprised of a plurality of pillar-shaped members arranged with a space between adjacent thereof in a lattice pattern, and said pressure adjusting means is comprised of said space between said pillar-shaped members.

10. The elevator according to claim 6, wherein said plate like member is comprised of mesh-shaped members, and said pressure adjusting means is comprised of a plurality of meshes of said mesh-shaped members.

11. The elevator according to claim 9, wherein an opening rate of said space is determined such that the opening rate increases in a direction approaching said car.

12. The elevator according to claim 9, wherein the opening rate of said space is determined such that the opening rate increases in a direction approaching said car.

13. The elevator according to claim 10, wherein an opening rate of said mesh is determined such that the opening rate increases in a direction approaching said car.

14. The elevator according to claim 10, wherein an opening rate of said mesh is determined such that the opening rate increases in a direction approaching said car.

15. The elevator according to claim 6, wherein said plate like member is arranged on the lower portion of said car.

16. An elevator comprising:

an ascending and descending car, said car having an entrance/exit front wall for allowing a passenger and an article to ascend and descend, side walls for forming both sides of said entrance/exit front wall, and a back wall opposed to said entrance/exit front wall;

a plate member mounted to extend in ascending and descending directions of said entrance/exit front wall, one side of which is mounted to said car, and the front end of another side of which is formed in a U-shape in ascending and descending directions of said entrance/exit front wall, is plainly formed from one side to a front end of another side; and accelerating flow suppressing means integrally mounted with said car for suppressing an accelerating flow generated along said entrance/exit front wall at a time of ascending and descending, wherein said accelerating flow suppressing means comprises a fairing cover integrally connected to the side walls and the end of another side of said plate member, with the front end extended in at least descending direction to the position equivalent to the front end of another side of said plate member said fairing cover forming a streamlined-shape in ascending and descending directions.

17. The elevator according to claim 16, wherein another plate member similar to said plate member is provides and each of plate members extends in ascending or descending directions of said car respectively, and said accelerating flow suppressing means is mounted in each of said plate members.

18. The elevator according to claim 16, wherein said plate member is integrally mounted with said fairing cover.

19. The elevator according to claim 16, wherein said fairing cover is connected to the side walls and the front end of another side of said plate member along with a contour of said plate member.

20. The elevator according to claim 16, wherein said fairing cover is inclined from said entrance/exit front wall to said back wall.

21. An elevator comprising:

an ascending and descending car, said car having an entrance/exit front wall for allowing a passenger and an article to ascend and descend, side walls for forming both sides of said entrance/exit front wall, a back wall opposed to said entrance/exit front wall, a bottom wall for forming a bottom in the ascending and descending directions, and an upper wall opposed to said bottom wall; and a lower fairing cover with a streamlined-shape provided to cover said bottom wall, wherein a portion of said lower fairing cover on the side of said entrance/exit front wall is formed to be flat so as to suppress the acceleration of flow rate of fluid to said entrance/exit front wall at a time of descending, a portion of said lower fairing cover is formed in a U-shape in the descending direction, and a portion of said lower faring cover on the side of said side walls and said back wall is formed in a streamlined-shape, being extended to a position equivalent to the front end of said entrance/exit front wall.

22. An elevator according to claim 21, further comprising:

a upper fairing cover provided to cover said upper wall, wherein a portion of said upper faring cover on the side of said entrance/exit front wall is formed to be flat so as to suppress the accelerating of flow rate of fluid to said entrance/exit front wall at a time of descending, a portion of said upper fairing cover is formed in a U-shape in the ascending direction, and a portion of said lower fairing cover on the side of said side walls and said back wall is formed in a streamlined-shape, being extended to a position equivalent to the front end of said entrance/exit front wall.

* * * * *